US010597260B2

(12) United States Patent
Hanninen et al.

(10) Patent No.: US 10,597,260 B2
(45) Date of Patent: Mar. 24, 2020

(54) ELEVATOR DOOR PANEL

(71) Applicants: Ari Hanninen, Helsinki (FI); Aki Haikonen, Helsinki (FI); Jussi Lahteenmaki, Helsinki (FI); Markku Haivala, Helsinki (FI); Juha Helenius, Helsinki (FI)

(72) Inventors: Ari Hanninen, Helsinki (FI); Aki Haikonen, Helsinki (FI); Jussi Lahteenmaki, Helsinki (FI); Markku Haivala, Helsinki (FI); Juha Helenius, Helsinki (FI)

(73) Assignee: Kone Corporation, Helsinki (FI)

( * ) Notice: Subject to any disclaimer, the term of this patent is extended or adjusted under 35 U.S.C. 154(b) by 246 days.

(21) Appl. No.: 15/584,112

(22) Filed: May 2, 2017

(65) Prior Publication Data

US 2017/0334682 A1 Nov. 23, 2017

(30) Foreign Application Priority Data

May 17, 2016 (EP) ..... 16169891

(51) Int. Cl.

| | |
|---|---|
| ***B66B 13/30*** | (2006.01) |
| ***B66B 9/00*** | (2006.01) |
| ***B66B 11/02*** | (2006.01) |
| ***B66B 13/08*** | (2006.01) |

(52) U.S. Cl.

CPC ..... *B66B 13/303* (2013.01); *B66B 9/00* (2013.01); *B66B 11/0226* (2013.01); *B66B 13/305* (2013.01); *B66B 13/08* (2013.01)

(58) Field of Classification Search

CPC ..... B66B 13/305; B66B 13/303

See application file for complete search history.

(56) References Cited

U.S. PATENT DOCUMENTS

| | | | | |
|---|---|---|---|---|
| 5,036,953 | A * | 8/1991 | Munz | B66B 13/305 160/196.1 |
| 6,082,499 | A * | 7/2000 | O'Donnell | E05D 15/12 16/87 R |
| 9,212,027 | B1 * | 12/2015 | Chase | B66B 13/08 |
| 2008/0264574 | A1 * | 10/2008 | Spiess | B66B 13/305 160/133 |
| 2009/0000199 | A1 | 1/2009 | Huynh et al. | |
| 2010/0062211 | A1 * | 3/2010 | Kawazoe | C08G 59/504 428/116 |
| 2013/0133261 | A1 | 5/2013 | Choi | |

FOREIGN PATENT DOCUMENTS

| | | | | |
|---|---|---|---|---|
| CA | 2592895 | A1 | 12/2008 | |
| EP | 2003082 | A1 * | 12/2008 | B66B 13/08 |
| FR | 2800055 | A1 * | 4/2001 | B66B 13/08 |
| JP | 2000192723 | A * | 7/2000 | B66B 13/305 |
| WO | WO-2005070807 | A2 | 8/2005 | |
| WO | WO-2005070807 | A3 | 8/2005 | |

OTHER PUBLICATIONS

European Search Report dated Nov. 8, 2016.

* cited by examiner

*Primary Examiner* — Diem M Tran

(74) *Attorney, Agent, or Firm* — Harness, Dickey & Pierce, P.L.C.

(57) ABSTRACT

The elevator door panel is formed of a composite material based on reinforcement fibres embedded in a polymer matrix material, the reinforcement fibres being arranged in the polymer matrix material so that the elevator door panel is stiff in a vertical plane, but can be bent to a curve around a vertical corner.

17 Claims, 7 Drawing Sheets

--Prior Art--

--Prior Art--

ELEVATOR DOOR PANEL

Figure 1:
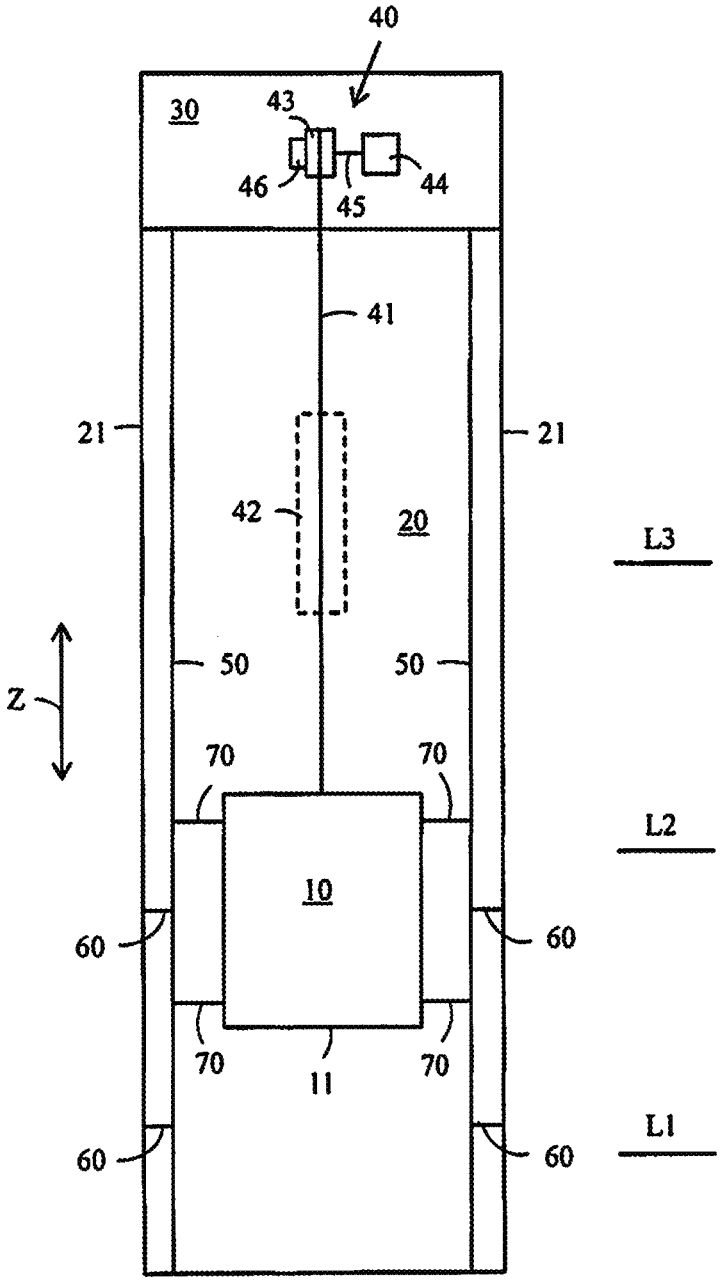

This application claims priority to European Patent Application No. EP16169891.5 filed on May 17, 2016, the entire contents of which are incorporated herein by reference.

FIELD

The invention relates to an elevator door panel. The elevator door panel may be used in an elevator car door arrangement and/or in an elevator landing door arrangement.

BACKGROUND

An elevator comprises typically an elevator car, an elevator shaft, a machine room, lifting machinery, ropes, and a counter weight. The elevator car is positioned within a sling that supports the elevator car. The lifting machinery comprises a sheave, a machinery brake and an electric motor for rotating the sheave. The lifting machinery moves the car in a vertical direction upwards and downwards in the vertically extending elevator shaft. The ropes connect the sling and thereby also the car via the sheave to the counter weight. The sling is further supported with gliding means on guide rails extending in the vertical direction in the shaft. The gliding means can comprise rolls rolling on the guide rails or gliding shoes gliding on the guide rails when the elevator car is mowing upwards and downwards in the elevator shaft. The guide rails are supported with fastening brackets on the side wall structures of the elevator shaft. The gliding means engaging with the guide rails keep the car in position in the horizontal plane when the elevator car moves upwards and downwards in the elevator shaft. The counter weight is supported in a corresponding way on guide rails supported on the wall structure of the shaft. The elevator car transports people and/or goods between landings arranged along the height of the shaft. The elevator shaft can be formed so that the wall structure is formed of solid walls or so that the wall structure is formed of an open steel structure.

The elevator car comprises a floor, a ceiling, a front wall and at least one further wall. The front wall and the at least one further wall extends between the floor and the ceiling. At least the front wall is provided with an opening and an elevator car door arrangement providing a passage for passengers and/or goods into and out of the elevator car. There is further an elevator landing door arrangement at each landing providing a passage for passengers and/or goods from the landing into the elevator car and from the elevator car into the landing.

The car door arrangement and the landing door arrangement may be based on a centre opening car door or on a side opening car door. A centre opening car door may comprise two or more elevator door panels opening from the centre in opposite directions outwards towards opposite sides of the elevator shaft. A side opening car door may comprise one or more elevator door panels opening in the same direction towards one side of the elevator shaft. The elevator door panels in a centre opening car door may move beyond the side to side width of the elevator car when they are opened. The elevator door panels in a side opening car door may also move beyond the side to side width of the elevator car. Additional space is thus required in the elevator shaft beyond the side to side width of the elevator car for the car door arrangement and/or the landing door arrangement.

Elevator door panels are in prior art solutions normally made of a steel frame and steel plates attached to the steel frame. The elevator door panels are thus rigid and rather heavy. The heavy elevator door panels require a rigid top rack for supporting the door panels. The elevator door panels may be suspended with rollers from a door guide rail in the top racket. The door guide rail may be a C-shaped guide rail with the opening in the C directed downwards. A glider with a frame having a pair of rollers attached to side surfaces at the front and at the back of the frame and a support bracket protruding downwards between the rollers and out of the opening in the C-shaped door guide rail may be used. The elevator door panel may be attached to the support bracket. The rollers may be situated within the C-shaped door guide rail and roll on the inner surfaces of the C-shaped door guide rail on both sides of the opening in the C.

SUMMARY

An object of the present invention is to provide an improved elevator door panel.

The elevator door panel according to the invention is defined in claim 1.

The elevator door panel is formed of a composite material based on reinforcement fibres embedded in a polymer matrix material, the reinforcement fibres being arranged in the polymer matrix material so that the elevator door panel is stiff in a vertical plane, but can be bent to a curve around a vertical corner.

The use of elevator car elevator door panels made of a composite material based on reinforcement fibres embedded in a polymer matrix material makes the elevator door panels light compared to traditional elevator door panels made of steel.

The use of composite material based on reinforcement fibres embedded in a polymer matrix material makes it possible to manufacture the elevator door panels so that they are stiff in the vertical plane but can still be bended around a vertical corner. This can be done by varying the orientation, the length and the amount of the reinforcement fibres in an appropriate way within the elevator door panel.

Fibre reinforced polymer (FRP) composites are made by combining a plastic polymer resin together with strong reinforcement fibres. The components retain their original form and contribute their own unique properties that result in a new composite material with enhanced overall performance. The fibres may be of glass, carbon, aramid or natural fibre. The polymer may be an epoxy, vinyl ester or polyester thermosetting plastic or thermoplastic.

Thermoplastic materials become pliable or mouldable above a specific temperature and solidifies upon cooling. They can thus be remoulded once heated above the specific temperature.

Thermosetting polymers are formed of pre-polymers in a soft solid or viscous state that changes irreversibly into an infusible, insoluble polymer network by curing.

The elevator door panels are made of a composite material based on fibre reinforcement embedded in a polymer matrix material. The use of fibre reinforcement embedded in a polymer matrix material makes the elevator door panels much lighter. The fibre reinforcement may be arranged so that the elevator door panels are bendable around a vertical corner, but are rigid in the vertical plane. This can be achieved by a stronger reinforcement in the vertical direction compared to the reinforcement in the horizontal direction.

The bending stiffness of the elevator door panel is greater in the vertical direction compared to the bending stiffness of the elevator door panel in the horizontal direction.

The in-plane stiffness of the elevator door panel is also greater in the vertical direction compared to in-plane stiffness of the elevator door panel in the horizontal direction.

The reinforcement fibres may be formed as at least one fabric layer being arranged so that the main direction is stiffer than the direction perpendicular to the main direction or as at least one layer of unidirectional fibres so that the main direction is stiffer than the direction perpendicular to the main direction or as at least one mat layer comprising chopped fibres arranged so that the main direction is stiffer than the direction perpendicular to the main direction.

The reinforcement fibres may also be formed as any combination of at least two of the above mentioned forms: at least one fabric layer, at least one unidirectional fibre layer and at least one mat layer.

A fabric layer comprises fibres at least in two main directions being perpendicular to each other. The fibres in the two main direction and the direction perpendicular to the main direction are continuous fibres.

A layer of unidirectional fibres comprises a layer of fibres in which most of the fibres are directed only in one main direction. The fibres in the single main direction are continuous fibres.

A mat layer comprising chopped fibres comprises chopped fibres laid randomly across each other and held together by the polymer matrix material. Such a mat comprising chopped fibres may be arranged to have isotropic in-plane properties or directed in-plane properties.

There are naturally also a certain amount of diagonally directed reinforcement fibres in the composite material in order to achieve a suitable overall rigidity of the elevator door panel.

The reinforcement fibres may be at least one or any combination of the following group: glass fibres, carbon fibres, aramid fibres, and natural fibres. Natural fibres such as kenaf, jute and hemp are used e.g. in composited in the automotive industry. The natural fibres may be treated in a proper way in order to e.g. increase their fire retarding properties.

The polymer matrix material may be at least one of the following group: epoxy, vinyl ester, polyester thermosetting plastic material and thermoplastic material.

Also fire retardant material layers may be used in the composite material in order to achieve a desired fire class of the elevator door panel.

DRAWINGS

Figure 2:
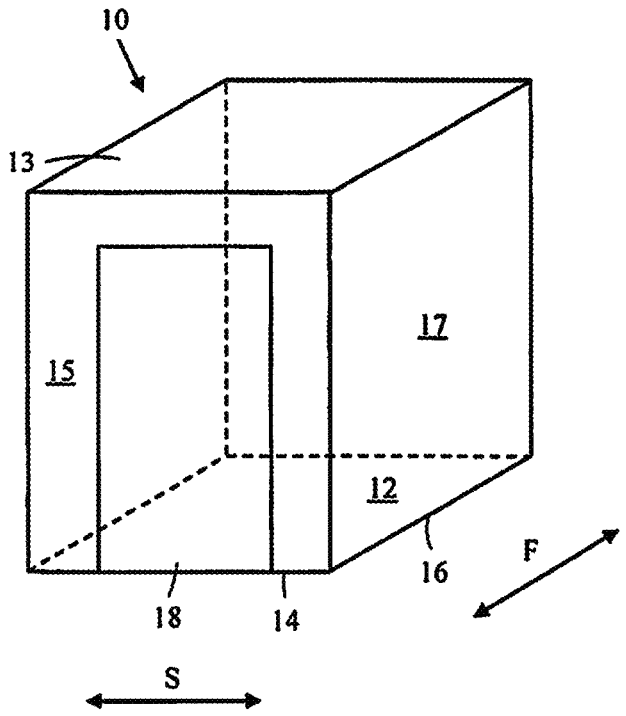
Figure 3:
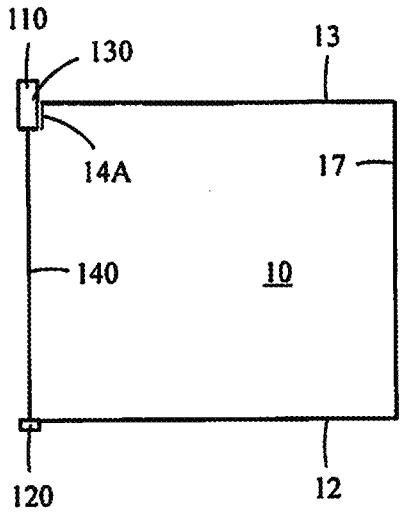
Figure 4:
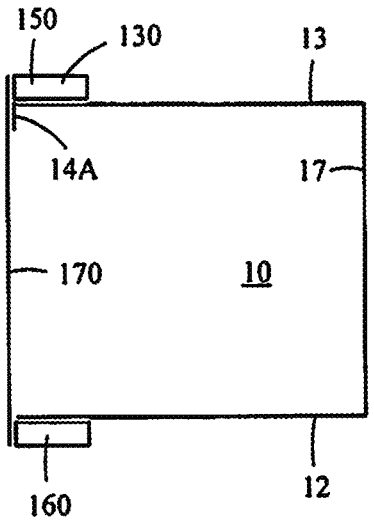
Figure 5:
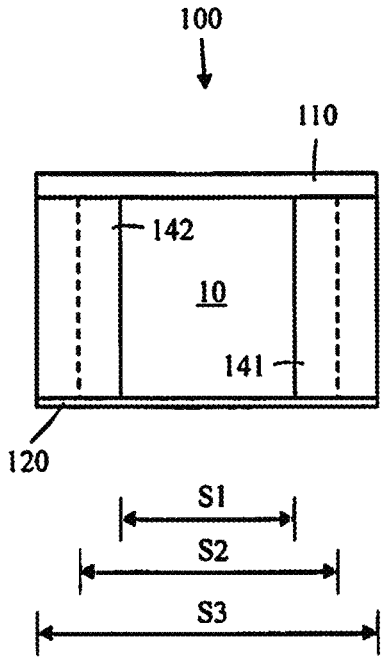
Figure 7:
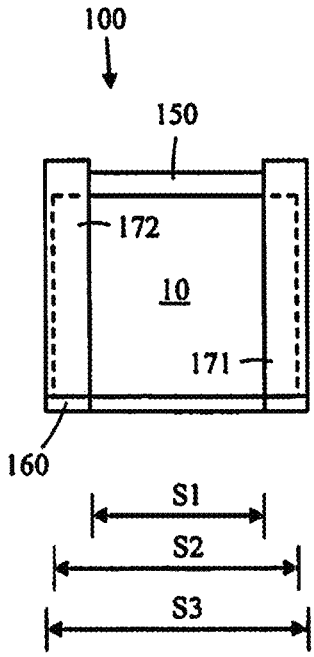
Figure 6:
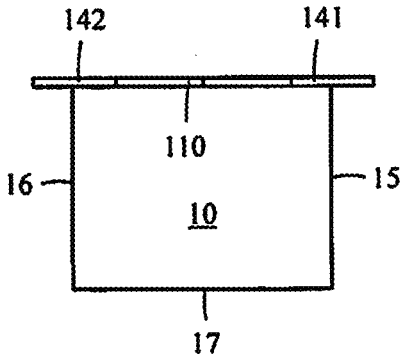
Figure 8:
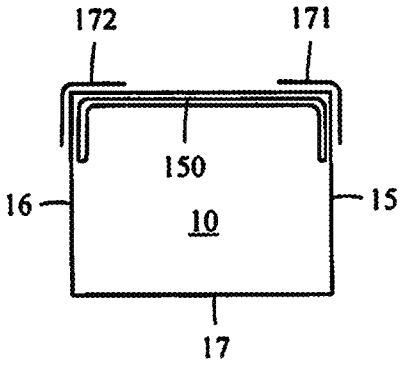
Figure 9:
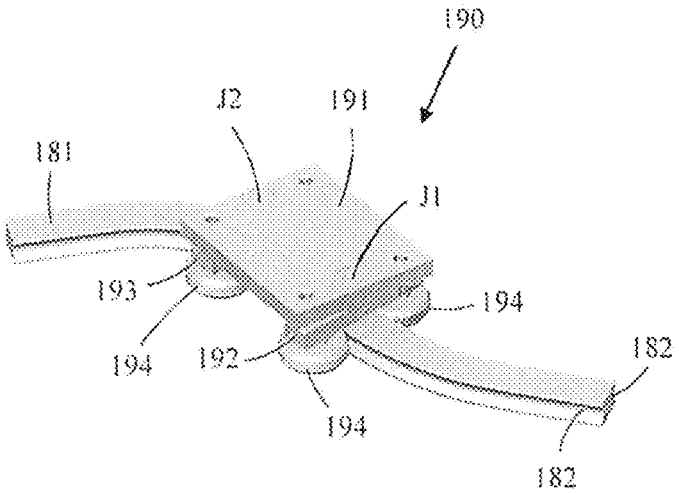
Figure 10:
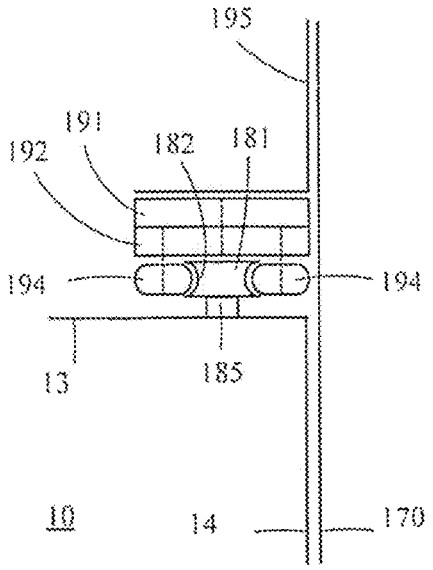
Figure 11:
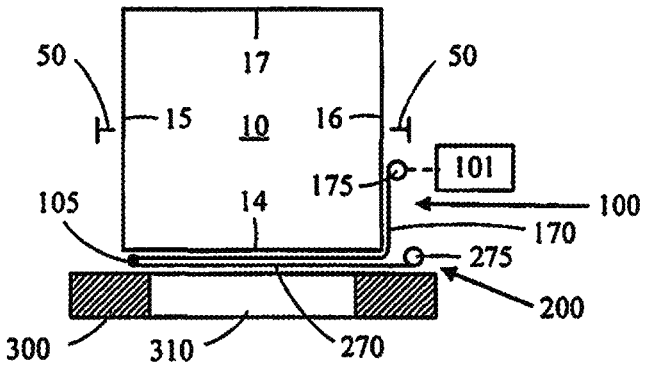
Figure 12:
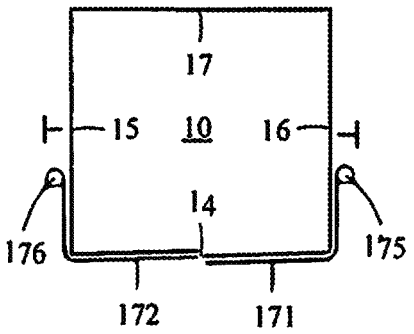
Figure 13:
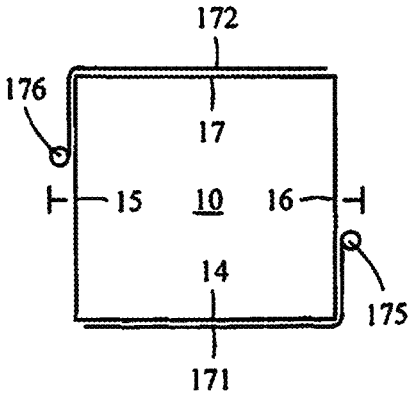
Figure 14:
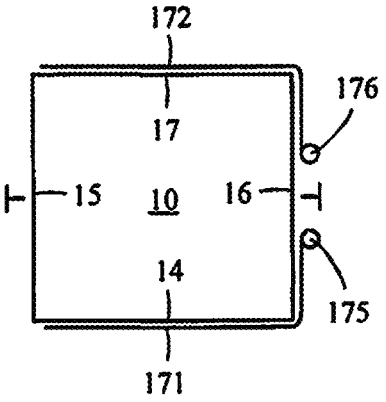
Figure 15:
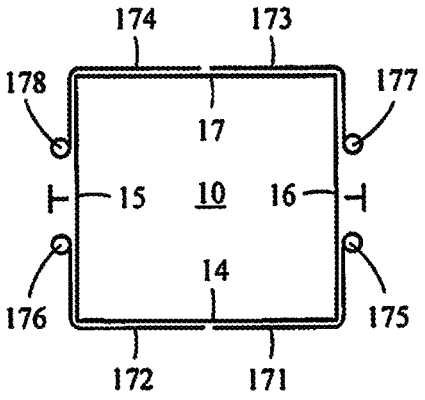
Figure 16:
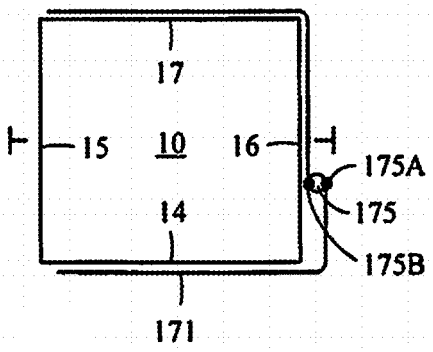
Figure 17:
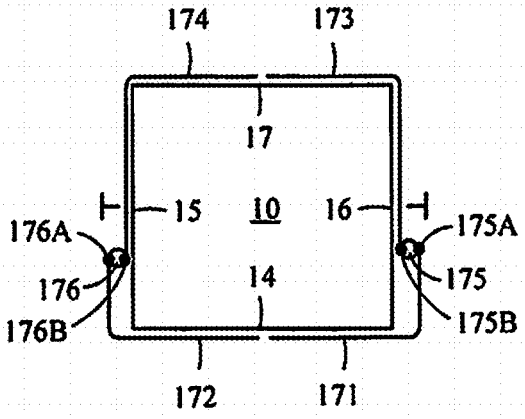
Figure 18:
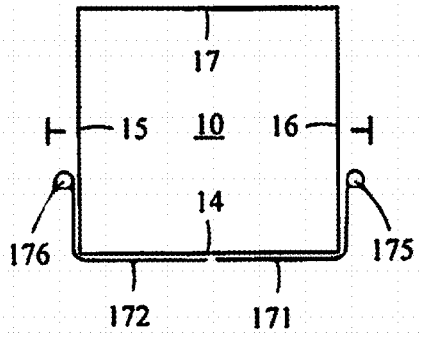
Figure 19:
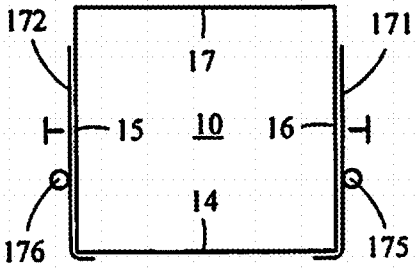
Figure 20:
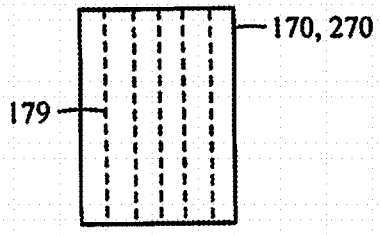
Figure 21C:
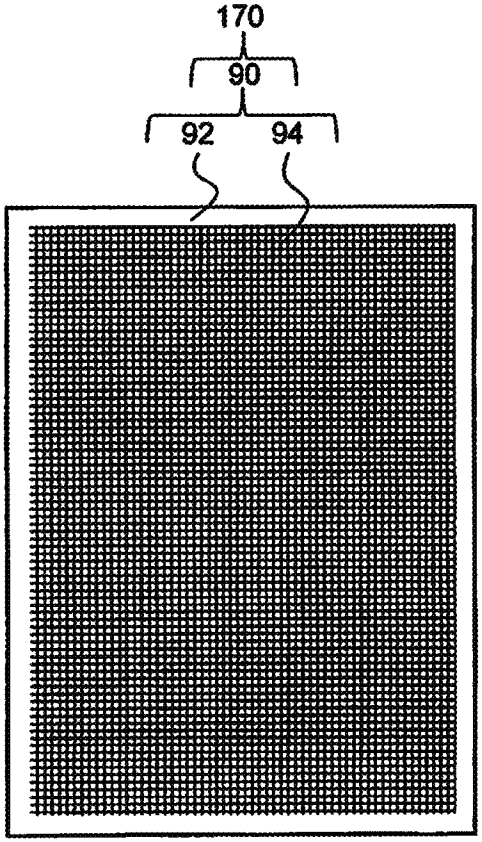
Figure 21B:
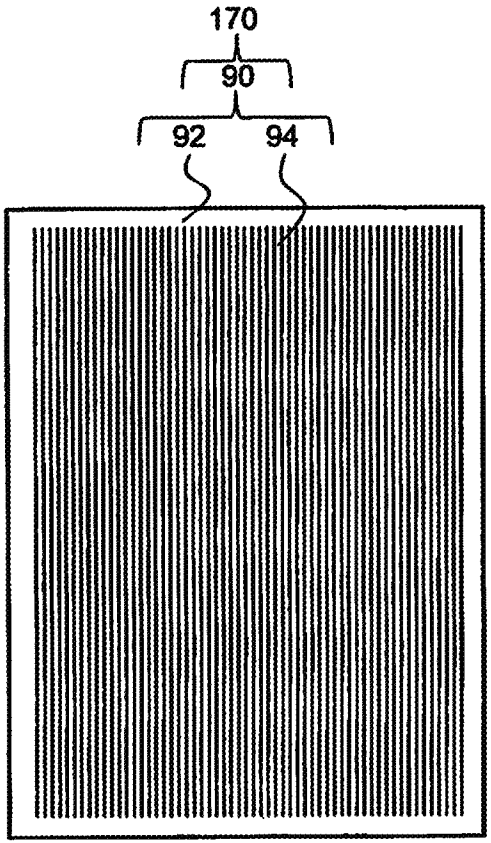
Figure 21A:
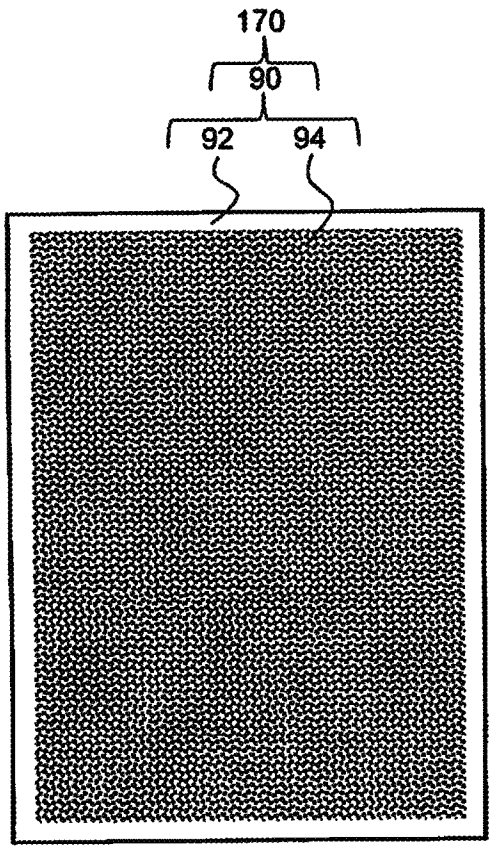

The invention will in the following be described in greater detail by means of preferred embodiments with reference to the attached drawings, in which FIG. 1 shows a vertical cross section of an elevator, FIG. 2 shows an axonometric view of an elevator car, FIG. 3 shows a vertical cross section in the front to back direction of a prior art car door arrangement, FIG. 4 shows a vertical cross section in the front to back direction of a car door arrangement, FIG. 5 shows a vertical cross section in the side to side direction of a prior art car door arrangement, FIG. 6 shows a horizontal cross section of the car door arrangement shown in FIG. 5, FIG. 7 shows a vertical cross section in the side to side direction of an inventive car door arrangement, FIG. 8 shows a horizontal cross section of the car door arrangement shown in FIG. 7, FIG. 9 shows a door guide rail and a roller slider, FIG. 10 shows the attachment of the elevator door panel to the roller slider by using the guide rail and roller slider of FIG. 9, FIG. 11 shows a horizontal cross section of a side opening car door and landing door arrangement, FIG. 12 shows a horizontal cross section of a first centre opening car door arrangement in a single door car, FIG. 13 shows a horizontal cross section of a first side opening car door arrangement in a through type car, FIG. 14 shows a horizontal cross section of a second side opening car door arrangement in a through type car, FIG. 15 shows a horizontal cross section of a first centre opening car door arrangement in a through type car, FIG. 16 shows a horizontal cross section of a third side opening car door arrangement in a through type car, FIG. 17 shows a horizontal cross section of a second centre opening car door arrangement in a through type car, FIG. 18 shows a horizontal cross section of a second centre opening car door arrangement in a single door car when the door is closed, FIG. 19 shows a horizontal cross section of the door arrangement of FIG. 18 when the door is open, FIG. 20 shows a view of an elevator door panel, FIG. 21A shows a view of an elevator door panel made of a composite material based on fibre reinforcement embedded in a polymer matrix material where the fibres are formed as a mat layer, FIG. 21B shows a view of an elevator door panel made of a composite material based on fibre reinforcement embedded in a polymer matrix material where the fibres are formed as a unidirectional fibre layer, FIG. 21C shows a view of an elevator door panel made of a composite material based on fibre reinforcement embedded in a polymer matrix material where the fibres are formed as a fabric layer.

DETAILED DESCRIPTION

FIG. 1 shows a vertical cross section of an elevator. The elevator comprises a car 10, an elevator shaft 20, a machine room 30, lifting machinery 40, ropes 41, and a counter weight 42. A frame called sling 11 surrounds the car 10 or is formed as an integral part of the car frame. The lifting machinery 40 comprises a sheave 43, a machinery brake 46 and an electric motor 44 for rotating the sheave 43 via a shaft 45. The lifting machinery 40 moves the car 10 in a vertical direction Z upwards and downwards in the vertically extending elevator shaft 20. The sling 11 is connected by the ropes 41 via the sheave 43 to the counter weight 42. The sling 11 is further supported with gliding means 70 at guide rails 50 extending in the vertical direction in the shaft 20. The figure shows two guide rails 50 at opposite sides of the car 10. The gliding means 70 can comprise rolls rolling on the guide rails 50 or gliding shoes gliding on the guide rails 50 when the car 10 is moving upwards and downwards in the elevator shaft 20. The guide rails 50 are attached with fastening brackets 60 to the side wall structures 21 in the elevator shaft 20. The figure shows only two fastening brackets 60, but there are several fastening brackets 60 along the height of each guide rail 50. The gliding means 70 engaging with the guide rails 50 keep the car 10 in position in the horizontal plane when the car 10 moves upwards and downwards in the elevator shaft 20. The counter weight 42 is supported in a corresponding way on guide rails that are attached to the wall structure 21 of the shaft 20. The machinery brake 46 stops the rotation of the sheave 43 and thereby the movement of the elevator car 10. The car 10 transports people and/or goods between the landings L1, L2, L3 arranged along the height of the shaft 20. The elevator shaft 20 can be formed so that the wall structure 21 is formed of solid walls or so that the wall structure 21 is formed of an open steel structure.

FIG. 2 shows an axonometric view of an elevator car. The elevator car 10 may form a parallelepiped having a horizontal bottom 12, a horizontal ceiling 13, a vertical front wall 14, two vertical side walls 15, 16, and a vertical back wall 17. The front wall 14, the side walls 15, 16 and the back wall 17 may extend between the bottom 12 and the ceiling 13. The parallelepiped is the most common form of an elevator car 10, but the elevator car 10 could e.g. comprise a straight front wall 14, two straight side walls 15, 16, and a curved back wall 17. The front wall 14 may comprise an opening 18, which may be provided with a car door arrangement (not shown in the figure) providing a passage for passengers and/or goods into and out of the elevator car 10. The elevator car 10 may be a single door car 10 having only one opening provided with a door arrangement at one side wall 14, 15, 16, 17 or the elevator car 10 may be a through type car 10 having an opening provided with a door arrangement on at least two side walls 14, 15, 16, 17. The invention can be used in any kind of elevator car 10. The front to back direction F and the side to side direction S have been indicated with respective arrows into the figure.

FIG. 3 shows a vertical cross section in the front to back direction of a prior art car door arrangement. The car door arrangement 100 comprises a top rack 110 attached to an upper vertical portion 14A of the front wall 14. The top rack 110 comprises one or several rails on which the car elevator door panels 140 are suspended via rollers. The lower edge of the car elevator door panels 140 are guided on a sill 120. The lower edge of the car elevator door panels 140 may be provided with downwards extending guide means seating in a groove in the sill 120. The height of the car elevator door panels 140 correspond to the height of the opening 18 in the front wall 14 of the car 10. The car door arrangement 100 comprises further a door operator 130, which may be integrated into the top rack 110. The car door arrangement may be based on centre opening or side opening elevator door panels 140. The elevator door panels 140 in the car 10 are in prior art solutions usually made of a steel sheets attached to a steel frame. This means that the elevator door panels 140 become rather heavy and rigid. The door operator 130 may comprise an electric motor driving a drive wheel via a belt. A system of link arms is connected between the drive wheel and the elevator door panels, whereby opening of the elevator door panels is achieved when the drive wheel is turned in one direction and closing of the elevator door panels is achieved when the drive wheel is turned in the opposite direction. A cogged belt could be used instead of the link arm system to move the elevator door panels. A door coupler may further be used to form a mechanical connection between the elevator door panels in the car door and the elevator door panels in the landing door when the car stops at a landing. The landing door opens and closes in synchronism with the opening and closing of the car door driven by the door operator positioned on the car or in the shaft on the landing.

FIG. 4 shows a vertical cross section in the front to back direction of a car door arrangement. The car door arrangement 100 comprises a top rack 150 attached to a top surface of the ceiling 13 of the elevator car 10 and a bottom rack 160 attached to a bottom surface of the floor 12 of the elevator car 10. The height of the elevator door panels 170 in the car 10 are greater compared to the height of the elevator door panels 140 in the car 10 in prior art car door arrangements. The elevator door panels 170 of the car 10 extend above the top surface of the ceiling 13 and below the bottom surface of the floor 12. Door guide rails may be provided in the top rack 150 and in the bottom rack 160. The elevator door panels 170 of the car 10 may be attached via a roller mechanism to the rail in the top rack 150 and to the door guide rail in the bottom rack 160. The car door arrangement 100 may further comprise a door operator 130, which may be integrated into the top rack 150 or into the bottom rack 160. The door operator 130 may be of any conventional type known to a skilled person. The car door arrangement may be based on centre opening or side opening elevator door panels 170. As shown in FIGS. 21A-21C, the elevator door panels 170 of the car 10 are in the inventive solution made of a composite material 90 based on fibre reinforcement 94 embedded in a polymer matrix material 92. The use of fibre reinforcement 94 embedded in a polymer matrix material 92 makes the elevator door panels 170 much lighter. The fibre reinforcement 94 may be arranged so that the elevator door panels 170 are bendable around a vertical corner, but are rigid in the vertical plane. This can be achieved by a stronger reinforcement in the vertical direction compared to the reinforcement in the horizontal direction. As shown in FIGS. 21A-21C, the reinforcement fibres 94 may be formed as at least one fabric layer being arranged so that the main direction is stiffer than the direction perpendicular to the main direction or as at least one layer of unidirectional fibres so that the main direction is stiffer than the direction perpendicular to the main direction or as at least one mat layer comprising chopped fibres arranged so that the main direction is stiffer than the direction perpendicular to the main direction. The reinforcement fibres 94 may also be formed as any combination of at least two of the above mentioned forms: at least one fabric layer, at least one unidirectional fibre layer and at least one mat layer. FIG. 21C illustrates reinforcement fibres 94 formed as a fabric layer. A fabric layer comprises reinforcement fibres 94 at least in two main directions being perpendicular to each other. The reinforcement fibres 94 in the two main direction and the direction perpendicular to the main direction are continuous fibres. FIG. 21B illustrates reinforcement fibres 94 formed as a layer of unidirectional fibres. A layer of unidirectional fibres comprises a layer of reinforcement fibres 94 in which most of the reinforcement fibres 94 are directed only in one main direction. The reinforcement fibres 94 in the single main direction are continuous fibres. FIG. 21A illustrates reinforcement fibres 94 formed as a mat layer. A mat layer comprising chopped fibres comprises chopped reinforcement fibres 94 laid randomly across each other and held together by the polymer matrix material 92. Such a mat comprising chopped reinforcement fibres 94 may be arranged to have isotropic in-plane properties or directed in-plane properties.

FIG. 5 shows a vertical cross section in the side to side direction and FIG. 6 shows a horizontal cross section of a prior art car door arrangement. The figure shows a centre opening car door arrangement 100 with two elevator door panels 141, 142. The elevator door panels 141, 142 are suspended with rollers on door guide rails in the top rack 110. The lower edge of the elevator door panels 141, 142 are provided with guide means protruding downwards from the lower edge of the elevator door panels 141, 142 and being seated in grooves in the sill 120. The figure shows the width S1 of the door opening, the width S2 of the elevator 10, and the total width S3 of the car door arrangement. The total width S3 of the car door arrangement is determined by the width of the top rack 110. The top rack 110 extends beyond the width S2 of the elevator car 120 in order to enable opening of the elevator door panels 141, 142. The width S1 of the car opening may in a prior art car door arrangement be 800 mm, the width S2 of the elevator car 10 being 1200 mm and the total width S3 of the car door arrangement being 1600 mm. The width of each elevator door panel 140 is 400 mm.

FIG. 7 shows a vertical cross section in the side to side direction and FIG. 8 shows a horizontal cross section of an inventive car door arrangement. The figure shows a centre opening car door arrangement 100 with two elevator door panels 171, 172. The upper edge of elevator door panels 171, 172 is supported with a roller arrangement on a top guide rail in the top rack 150. The lower edge of the elevator door panels 171, 172 is supported in a corresponding way with a roller arrangement on a bottom guide rail in the bottom rack 160. The figure shows the width S1 of the door opening, the width S2 of the elevator 10, and the total width S3 of the car door arrangement. The width S1 of the car opening may in this inventive car door arrangement be 800 mm, the width S2 of the elevator car 10 being 1200 mm and the total width S3 of the car door arrangement being 1240 mm. The rail in the top rack 150 and in the bottom rack 160 may have a radius of curvature of 100 mm, which will make it possible to achieve a total width of only 1240 mm. The thickness of the elevator door panel 171, 172 may be 5 mm or less.

The top rack 150 and the bottom rack 160 comprises a first straight portion running parallel to the front wall 14 along the length of the front wall 14, a curved portion at each side edge of the front wall 14, and a second straight portion after the curved portion running parallel to the side walls 15, 16.

The top door guide rail 181 and the bottom door guide rail 181 comprises in the same way a first straight portion running parallel to the front wall 14 along the length of the front wall 14, a curved portion at each side edge of the front wall 14, and a second straight portion after the curved portion. The curved portion comprises a 90-degree curve. The second straight portions run in a direction perpendicular to the front wall 14. The first straight portion runs in the side to side direction S and the second straight portions run in the back to front direction F. The elevator door panels 171, 172 will thus bend 90-degrees when the elevator door panel 171, 172 opens and glides along the curved portion of the top guide rail 181 and the bottom guide rail 181.

A door operator based on a cogged belt may be used to move the elevator door panels 171, 172. A door with two middle opening elevator door panels 171, 172 may be operated by two belts. The first elevator door panel 171 may be operated by a first belt running over three drums forming a triangle. A first drum may be positioned at the middle of the front wall 14 of the car 10, a second drum at the corner between the front wall 14 and the side wall 14, and a third drum at the side wall 15 at a required distance from the front wall 14. A back and forth movement of the belt will open and close the elevator door panel 171. The second elevator door panel 172 may be operated in a similar way by a second belt running over three drums forming a corresponding triangle. This door operator arrangement can naturally also be used in connection with a side opening door. Only one belt running over three drums arranged in a triangle is then needed. The drum on the side wall 15 can be positioned in or near the corner between the beck wall 17 and the side wall 15. The door operator may be positioned on the ceiling 13 of the car 10 or on the bottom 12 of the car 10.

FIG. 9 shows a door guide rail and a slider. The door guide rail 181 is a horizontal door guide rail 181 provided with U-shaped grooves 182 on both vertical side surfaces of the door guide rail 181. The slider 190 comprises a rectangular slider body 191 being parallel to the door guide rail 181 when the slider 190 is installed to the door guide rail 181. The slider 190 comprises further two support arms 192, 193 at each end portion of the slider body 191. Each support arm 192, 193 is rotatably attached by an articulated joint J1, J2 positioned in the middle of the support arm 192, 193 to the slider body 191. The slider 190 comprises further a roller 194 at each end of each support arm 192, 193. The shaft of each roller 194 is attached to a respective end of a respective support arm 192, 193. The opposite rollers 194 at the ends of each support arm 192, 193 become seated within the U-shaped grooves in the door guide rail 181 when the slider 190 is installed on the door guide rail 181. The distance between the articulated joints J1, J2 can be rather short so that the slider 190 can run smoothly even through tight turns in the door guide rail 181. The articulated joints J1, J2 are positioned in the middle of the door guide rail 181 when the slider 190 is installed on the door guide rail 181.

FIG. 10 shows the attachment of the elevator door panel to the roller slider by using the guide rail and roller slider of FIG. 9. The figure shows the door guide rail 181 attached trough a distance piece 185 to the upper surface of the ceiling 13 of the car 10. The rollers 194 are seated in the side grooves 182 of the door guide rail 181. The shaft of each roller 194 is attached to an end of a respective support arm 192 and each support arm 192, 193 is rotatably attached from the middle point of the support arm 192, 193 to the slider body 191 via an articulated joint J1, J2. A support bracket 195 may be formed as an integral part of the elevator door panel 170. The support bracket 195 may be laminated into the composite material of the elevator door panel 170 during the manufacture of the composite material of the elevator door panel 170 or the support bracket 195 may be glued to the completed composite material of the elevator door panel 170. The support bracket 195 has advantageously an L-shaped form, but the support bracket 195 could be of any form. The support bracket 195 may be attached to the slider body 191 with any suitable flexible fastening arrangement. The flexible fastening arrangement should allow for the bending of the elevator door panel 170 around a vertical corner 170 when the elevator door panel 170 glides around the curved corner in the door guide rail 181.

The door guide rails 181 and the sliders 190 shown in the figures may be used in the inventive car door arrangement. The door guide rails 181 may be installed in the top rack 150 and in the bottom rack 160. The top rack 150 may be attached to the upper surface of the ceiling 13 of the elevator car 10 and the guide rail 181 may be attached to the top rack 150 so that the slider 190 can freely run on the door guide rail 181. The bottom rack 160 may be attached to the lower surface of the floor 12 of the elevator car 10 and the guide rail 181 may be attached to the bottom rack 160 so that the slider 190 can freely run on the door guide rail 181. The elevator door panels 170 may thus be supported from their upper edge on the top door guide rail 181 and from their lower edge on the bottom door guide rail 181 with the support brackets 195. A suitable number of sliders 190 may be used for supporting each elevator door panel 170 on the door guide rail 181. The roller slider 190 shown in the figures may advantageously be used with the door guide rail 181, but the invention is not limited to this kind of roller slider 190. Any kind of roller slider can be used in the invention which is able to pass around the curved corner in the guide rail 181.

This support arrangement makes it possible to have the elevator door panels 170 run very close to the front wall 14 of the car 10 and also very close to the elevator door panels in the landing door arrangement.

The radius of curvature of the guide rail 181 may be 100 mm, which means that the elevator door panel 170 must be able to accommodate to this curvature when passing along the curved portion of the door guide rail 181. The thickness of the elevator door panel 170 may be 5 mm or less. There might be a need to increase the thickness of the elevator door panel 170 at the vertical edge of the elevator door panel 170 that closes the door opening. This can be done e.g. by adding a list on the inner surface of the elevator door panel 170 increasing the thickness of the elevator door panel 170 locally. The increased thickness might be needed to increase the area with which the elevator door panel acts e.g. on fingers being left between a closing elevator door panel 170. The increase in thickness could also be achieved by positioning a light curtain at the inner edge of the elevator door panel 170. A holder e.g. in the form of a U-shaped groove for the light curtain could be integrated into the elevator door panel 170. The light curtain could thus be pushed into the holder. Different equipment needed in connection with the light curtain could be positioned in the top rack 150 and/or in the bottom rack 160.

A safety system may be integrated into the elevator door panel 170 in order to detect possible excessive wearing of the elevator door panel 170. Wearing of the elevator door panel 170 may occur if the elevator door panel 170 touches against the shaft wall or against the landing elevator door panels during movement of the car or during opening and closing of the elevator door panels 170. This may be done e.g. by adding one or more electrical wire loops to the shaft side surface of the elevator door panel 170. A broken wire loop indicates excess wear of the elevator door panel 170.

The elevator door panel 170 may on the other hand be provided with a layer e.g. a printed conductor network or equivalent in order to supervise mechanical integrity of the elevator door panel 170. Damages due to sliding friction and impacts could be detected with such a layer and the car could be taken out of use for maintenance immediately when the failure occurs.

The elevator door panel 170 may also as an alternative or in addition be provided with sensors in order to detect contact between the elevator door panel 170 and the shaft wall, or with sensors in order to detect excessive vertical bending (pressure) of the elevator door panel 170. The information of the sensors could be used to initiate preventive maintenance measures or in extreme cases to immediately stop the car.

The locking of the elevator door panels 170 in the inventive arrangement may be based on traditional electromechanical locking arrangements or on electromagnetic locking arrangements. The locking of the elevator door panels 170 may be done with bi-stable actuators. A bi-stable actuator may be based on a permanent magnet connected to the spindle and moving between two opposite electromagnets. Supplying one electromagnet to provide an electromagnetic field pulse adding to the permanent magnet field and making the opposite with the second electromagnet allows the permanent magnet to move towards the first electromagnet, and vice a versa.

The door coupler in the inventive arrangement may be based on a traditional mechanical door coupler or on an electromechanical door coupler or on an electromagnetic door coupler. Another possibility may be to use bi-stable actuators as door couplers in the inventive arrangement.

The rigidity of the elevator door panels 170 could be further increased by using a "tightening method" when closing the elevator door panels 170. This could be achieved by interlocking the two centre opening opposite elevator door panels 170 tightly when they are closed after which the door operators would be instructed to pull the elevator door panels 170 "open" with a certain tensioning force. The elevator door panels 170 would thus be under a certain tension when they are closed. This "tightening method" would naturally also be possible to use with only one elevator door panel 170.

The top door guide rail 181 and the bottom door guide rail 181 may be identical guide rails.

The elevator door panel 170 is in the figure bent 90 degrees around the corner of the car 100. This is an advantageous embodiment, but the curvature of the elevator door panel 170 at the corner of the car 10 may be less than 90 degrees.

FIG. 11 shows a horizontal cross section of a side opening car door and landing door arrangement in a single door car. The single door is arranged on the front wall 13 of the car 10. The elevator car door arrangement 100 comprises an elevator door panel 170 and a drum 175. The elevator door panel 170 in the car door arrangement 100 will be wound on the drum 175 when the car door is opened and wound from the drum 175 when the car door is closed. The landing wall 300 comprises an opening 310 provided with a landing door arrangement 200 on the shaft 20 side of the landing. The landing door arrangement 200 comprises an elevator door element 270 and a drum 275. The elevator door panel 270 in the landing door arrangement 200 will be wound on the drum 275 when the landing door is opened and wound from the drum 275 when the landing door is closed. The actuator that moves the elevator door panels 170, 270 can be connected to the car side drum 175 and/or to the landing side drum 275. The door panel 170 in the car door and the door panel 270 in the landing door may on the other hand be mechanically connected with a coupler 105. The coupler 105 connects the door panel 170 in the car door and the door panel 270 in the landing door together when the car 10 stops at the landing L1, L2, L3 so that they move in synchronism. The use of a coupler 105 means that only one actuator for moving the elevator door panels 170, 270 is needed. The actuator may consist of an electric motor and/or a spring. The drum 175 of the door panel 170 of the car door is in the figure driven by a motor 101 e.g. an electric motor. The motor 101 rotates the drum 175, whereby the elevator door panel 170 of the car door can be wound on the drum 175 and from the drum 175.

FIG. 12 shows a horizontal cross section of a first centre opening car door arrangement in a single door car. The single door is arranged on the front wall 13 of the car 10. The arrangement comprises a first door panel 171 operated by a first drum 175 positioned on a first side wall 16 of the car 10 and a second door panel 172 operated by a second drum 176 positioned on a second opposite side wall 15 of the car 10. Both door panels 171, 172 are wound on the respective drum 175, 176 when the car door is opened and wound from the respective drum 175, 176 when the car door is closed.

FIG. 13 shows a horizontal cross section of a first side opening car door arrangement in a through type car. A first door is arranged on the front wall 13 of the car 10 and a second door is arranged on the back wall 17 of the car 10. The first door arrangement comprises a first door panel 171 operated by a first drum 175 positioned on the first side wall 16 of the car 10. The second door arrangement comprises a second door panel 172 operated by a second drum 176 positioned on the second side wall 15 of the car 10. Both door panels 171, 172 are wound on the respective drum 175, 176 when the car door is opened and wound from the respective drum 175, 176 when the car door is closed.

FIG. 14 shows a horizontal cross section of a second side opening car door arrangement in a through type car. A first door is arranged on the front wall 13 of the car 10 and a second door is arranged on the back wall 17 of the car 10 in the same way as in FIG. 13. The drums 175 and 176 are in this embodiment arranged on the same side wall 16 of the car 10.

FIG. 15 shows a horizontal cross section of a first centre opening car door arrangement in a through type car. The door arrangement at the first door on the front wall 14 of the car 10 and the door arrangement at the second door on the back wall 17 of the car 10 corresponds to that shown in FIG. 12. The arrangement at the first door comprises a first door panel 171 operated by a first drum 175 positioned on a first side wall 16 of the car 10 and a second door panel 172 operated by a second drum 176 positioned on a second opposite side wall 15 of the car 10. Both door panels 171, 172 are wound on the respective drum 175, 176 when the first door is opened and wound from the respective drum 175, 176 when the first door is closed. The arrangement at the second door comprises a first door panel 173 operated by a first drum 177 positioned on a first side wall 16 of the car 10 and a second door panel 174 operated by a second drum 178 positioned on a second opposite side wall 15 of the car 10. Both door panels 173, 174 are wound on the respective drum 177, 178 when the second door is opened and wound from the respective drum 177, 178 when the second door is closed.

FIG. 16 shows a horizontal cross section of a third side opening car door arrangement in a through type car. A first door is arranged on the front wall 13 of the car 10 and a second door is arranged on the back wall 17 of the car 10. The first door arrangement comprises a first door panel 171 operated by a first drum 175 positioned on the first side wall 16 of the car 10. The second door arrangement comprises a second door panel 172 operated by the same first drum 175 positioned on the first side wall 16 of the car 10. There is a first coupler 175A for connecting and disconnecting the first door panel 171 to the first drum 175. There is further a second coupler 175B for connecting and disconnecting the second door panel 172 to the first drum 175. The door panels 171, 172 can thus be wound on the drum 175 and from the drum 175 one at a time. It is thus possible to open and close either the first door or the second door at a time at a landing L1, L2, L3.

FIG. 17 shows a horizontal cross section of a second centre opening car door arrangement in a through type car. A first door is arranged on the front wall 13 of the car 10 and a second door is arranged on the back wall 17 of the car 10. The arrangement at the first door comprises a first door panel 171 operated by a first drum 175 positioned on a first side wall 16 of the car 10 and a second door panel 172 operated by a second drum 176 positioned on a second opposite side wall 15 of the car 10. Both door panels 171, 172 are wound on the respective drum 175, 176 when the first door is opened and wound from the respective drum 175, 176 when the first door is closed. The arrangement at the second door comprises a third door panel 173 operated by the first drum 175 positioned on the first side wall 16 of the car 10 and a fourth door panel 174 operated by the second drum 176 positioned on the second opposite side wall 15 of the car 10. Both door panels 173, 174 are wound on the respective drum 177, 178 when the second door is opened and wound from the respective drum 177, 178 when the second door is closed. There is a first coupler 175A for connecting and disconnecting the first door panel 171 to the first drum 175. There is further a second coupler 175B for connecting and disconnecting the third door panel 173 to the first drum 175. The first door panel 171 and the third door panel 173 can thus be wound on the first drum 175 and from the first drum 175 one at a time. There is further a third coupler 176A for connecting and disconnecting the second door panel 172 to the second drum 176. There is further a fourth coupler 176B for connecting and disconnecting the fourth door panel 174 to the second drum 176. The second door panel 172 and the fourth door panel 174 can thus be wound on the second drum 176 and from the second drum 176 one at a time. It is thus possible to open and close either the first door or the second door at a time at a landing L1, L2, L3.

FIG. 18 shows a horizontal cross section of a second centre opening car door arrangement in a single door car when the car door is closed and FIG. 19 shows a horizontal cross section of the car door arrangement of FIG. 18 when the car door is open. The door panels 171, 172 in the car door are not wound around the respective drum 175 and 176 in this embodiment. The door panels 171, 172 are coupled to the respective drum 175, 176 e.g. based on friction or a shape-locked connection e.g. based on teeth so that rotation of the drum 175, 172 will move the door panel 171, 172 in order to close or open the door. The door panels 171, 172 will thus pass the drum 175, 176 on the respective side wall 15, 16 of the car 10 when the door panels 171, 172 move in order to open and close the door.

FIG. 20 shows a view of an elevator door panel. The elevator door panel 170, 270 may comprise vertically directed stiffeners 179 formed of the reinforcement fibres and being positioned at a predetermined distance from each other in the horizontal direction. The stiffeners 179 form an integral part of the elevator door panel 170, 270. The stiffeners 179 may be manufactured in a separate process of the same reinforcement fibres that are used in the elevator door panel 170, 270. The separately manufactured stiffeners 179 may then be glued to the elevator door panel 170, 270. Another possibility is to add the separately manufactured stiffeners 179 to the elevator door panel 170, 270 during the lamination of the elevator door panel 170, 270. The stiffeners 179 form an additional vertical reinforcement of the elevator door panel 170, 270. The stiffeners 179 are arranged so that the elevator door panel 170, 270 can still be bent around a vertical corner. The stiffeners 179 form an integral part of the elevator door panel 170, 270. The stiffeners 179 may have a T-profile, an L-profile, a Z-profile or a U-profile. The stiffeners 179 may on the other hand also have a closed profile the cross-section of the profile being of a rectangular form. The stiffeners 179 may be of the same material as the reinforcement fibres. The stiffeners 179 may on the other hand be of metal e.g. of aluminium.

The landing door arrangement 200 shown in FIG. 11 can naturally be used in connection with each of the car door arrangements 100 shown in FIGS. 12-19.

The guide rail and slider arrangement shown in FIGS. 9 and 10 may be used in all embodiments of the invention.

The at least one elevator door panel 170, 270 may be used only in the car door arrangement 100 or only in the landing door arrangement 200 or in both the car door arrangement 100 and the landing door arrangement 200. The elevator may thus be provided with only a car door arrangement 100 in which the at least one elevator door panel 170 is used or the elevator may be provided with only a landing door arrangement 200 in which the at least one elevator door panel 270 is used or the elevator may be provided with a car door arrangement 100 in which the at least one elevator car door panel 170 is used and with a landing door arrangement 200 in which the at least one elevator door panel 270 is used.

The use of the invention is naturally not limited to the type of elevator shown in the figures. The invention can be used in any type of elevator e.g. also in an elevator lacking a machine room and/or a counterweight. The counterweight may be positioned on either side wall or on both side walls or on the back wall in the elevator shaft. The sheave, the machine brake and the motor may be positioned in the machine room or somewhere in the elevator shaft.

The invention can be applied in connection with any type of elevator car having at least one car door arrangement. The elevator door panels 170 in the car could be centre opening or side opening and there could be any number of elevator door panels 170 in the car door arrangement. The advantage with a side opening elevator door panel 170 is that there is no gap between the opposite elevator door panels 170, which reduces the noise in the car. The risk of leaving fingers between opposite elevator door panels 170 is also eliminated in a side opening elevator door panel 170. The advantage with centre opening elevator door panels 170 is that less space is required on the side of the car. Centre opening elevator door panels 170 also provide for a faster opening and closing of the elevator door panels 170.

The elevator car may be a single door car i.e. a car provided with only one door at one side wall. The elevator car may on the other hand be a through type elevator car provided with at least two doors at two different side walls. The car may e.g. be provided with two doors i.e. a first door on a first wall of the car and a second door on a second opposite wall of the car. The two doors need not be on opposite walls of the car, but can instead be on adjacent walls of the car. The car may even be provided with three doors on three adjacent walls of the car in case of a rucksack elevator where the two guide rails of the car are positioned on the same wall in the shaft.

It will be obvious to a person skilled in the art that, as the technology advances, the inventive concept can be implemented in various ways. The invention and its embodiments are not limited to the examples described above but may vary within the scope of the claims.

The invention claimed is:

1. An elevator door panel, the elevator door panel including a composite material based on reinforcement fibres embedded in a polymer matrix material, the reinforcement fibres being arranged in the polymer matrix material so that
- the elevator door panel is stiff in a vertical plane, and
- the elevator door panel is flexible in a horizontal plane such that the elevator door panel is configured to be bent to a curve around a vertical corner,
- wherein the elevator door panel is attached to a top roller slider and a bottom roller slider, such that the elevator door panel is configured to be glidingly supported on top and bottom door guide rails via the top and bottom roller sliders, respectively,
- wherein the top roller slider includes
  - a top slider body that is parallel to the top door guide rail,
  - two top support arms rotatably attached to separate, opposite end portions of the top slider body, each top support arm rotatably attached to the top slider body by a separate articulated joint positioned in a middle of the top support arm, and
  - a plurality of top rollers, wherein separate top rollers, of the plurality of top rollers, are attached to opposite ends of each top support arm, wherein the separate top rollers that are attached to the opposite ends of each top support arm are configured to be seated within separate U-shaped grooves in the top door guide rail, based on the top roller slider being installed on the top door guide rail,
- wherein the bottom roller slider includes
  - a bottom slider body that is parallel to the bottom door guide rail,
  - two bottom support arms rotatably attached to separate, opposite end portions of the bottom slider body, each bottom support arm rotatably attached to the bottom slider body by a separate articulated joint positioned in a middle of the bottom support arm, and
  - a plurality of bottom rollers, wherein separate bottom rollers, of the plurality of bottom rollers, are attached to opposite ends of each bottom support arm, wherein the separate bottom rollers that are attached to the opposite ends of each bottom support arm are configured to be seated within separate U-shaped grooves in the bottom door guide rail, based on the bottom roller slider being installed on the bottom door guide rail.

2. The elevator door panel according to claim 1, wherein the elevator door panel is configured to be bent 90 degrees around the vertical corner.

3. The elevator door panel according to claim 1, wherein a bending stiffness of the elevator door panel in the vertical plane is greater than a bending stiffness of the elevator door panel in the horizontal plane.

4. The elevator door panel according to claim 1, wherein
- the reinforcement fibres are in a shape of
  - a fabric,
  - unidirectional fibres,
  - a mat,
  - a sub-combination thereof, or
  - a combination thereof, and
- the reinforcement fibres are arranged so that a main direction associated with the reinforcement fibres is stiffer than a direction perpendicular to the main direction.

5. The elevator door panel according to claim 1, wherein the reinforcement fibres are
- glass fibres,
- carbon fibres,
- aramid fibres,
- natural fibres,
- a sub-combination thereof, or
- a combination thereof.

6. The elevator door panel according to claim 1, wherein the polymer matrix material is at least one of
- epoxy,
- vinyl ester,
- polyester thermosetting plastic, and
- thermoplastic.

7. The elevator door panel according to claim 1, wherein the elevator door panel includes vertically directed stiffeners, the vertically directed stiffeners including the reinforcement fibres; the vertically directed stiffeners positioned at a particular distance from each other in the horizontal plane, the vertically directed stiffeners forming an integral part of the elevator door panel.

8. An elevator car door arrangement, comprising:

at least one elevator door panel according to claim 1, the at least one elevator door panel being glidingly arranged in the elevator car door arrangement, wherein the elevator car door arrangement is on at least one side wall of an elevator car, such that the elevator car door arrangement defines a passage for passengers and/or goods into the elevator car and out from the elevator car.

9. An elevator car, comprising:

the elevator car door arrangement according to claim 8, wherein the elevator car includes a floor, a ceiling, a front wall, and at least one further wall, the front wall and the at least one further wall extending between the floor and the ceiling, at least the front wall being including both an opening and the elevator car door arrangement, such that the at least one side wall of the elevator car is at least the front wall, and the front wall is configured to define the passage for passengers and/or goods into the elevator car and out from the elevator car.

10. The elevator car according to claim 9, wherein the elevator car door arrangement further includes a door operator configured to open and close the at least one elevator door panel, the door operator including a drum and a motor, the drum on a side wall of the elevator car and configured to be rotated by the motor, the at least one elevator door panel is configured to be opened and closed with the drum, the at least one elevator door panel being connected to the drum so that the elevator door panel is configured to pass the drum during opening and closing of the elevator door panel, respectively, or the elevator door panel is configured to be wound on the drum and from the drum during opening and closing of the elevator door panel, respectively.

11. An elevator, comprising:

an elevator car according to claim 9, the elevator car configured to move upwards and downwards in a shaft between landings distributed along a height of the shaft.

12. The elevator car according to claim 9, wherein the at least one elevator door panel extends in the vertical plane above the ceiling of the elevator car and below the floor of the elevator car, the top door guide rail is supported on a top surface of the ceiling of the elevator car, and the bottom door guide rail is supported on a bottom surface of the floor of the elevator car.

13. The elevator car according to claim 12, wherein each door guide rail of the top door guide rail and the bottom door guide rail includes a straight portion extending along the front wall, at least one curved portion with a 90-degree curve at a side edge of the front wall, and an additional straight portion extending perpendicular to the front wall, and the at least one elevator door panel is configured to bend 90-degrees when the at least one elevator door panel opens and glides along the at least one curved portion of the top door guide rail and the bottom door guide rail.

14. The elevator car according to claim 12, wherein each door guide rail of the top door guide rail and the bottom door guide rail is a horizontal door guide rail including U-shaped grooves at each side surface of the door guide rail.

15. The elevator car according to claim 12, wherein the at least one elevator door panel includes a support bracket through which the at least one elevator door panel is configured to be flexibly attached to a slider body of at least one roller slider of the top roller slider and the bottom roller slider, the support bracket being an integral part of the at least one elevator door panel.

16. An elevator, comprising:

at least one elevator door panel according to claim 1, the at least one elevator door panel being glidingly arranged in an elevator landing door arrangement on a landing in an elevator shaft, the at least one elevator door panel configured to define a passage for passengers and/or goods from the landing into an elevator car and out from the elevator car to the landing.

17. An elevator, comprising:

an elevator shaft including a plurality of landings distributed along a height of the elevator shaft, each landing of the plurality of landings including a landing door arrangement, an elevator car configured to move upwards and downwards in the elevator shaft, the elevator car including at least one car door arrangement, wherein at least one door arrangement of the at least one car door arrangement and the landing door arrangement includes the elevator door panel according to claim 1.

* * * * *